United States Patent [19]

Foster

[11] Patent Number: 4,823,720

[45] Date of Patent: Apr. 25, 1989

[54] BATTEN ATTACHMENT

[76] Inventor: Lewis R. Foster, 112 Bond Ct., Los Gatos, Calif. 95302

[21] Appl. No.: 77,178

[22] Filed: Jul. 24, 1987

[51] Int. Cl.[4] ..... B63H 9/10

[52] U.S. Cl. ..... 114/98; 114/97; 114/103; 114/108; 403/58

[58] Field of Search ..... 114/89, 39, 97–99, 114/102, 103, 106–108; 464/160; 403/54, 58, 52, 53, 378, 377

[56] References Cited

U.S. PATENT DOCUMENTS

| | | | |
|---|---|---|---|
| 1,650,759 | 11/1927 | Larsen | 114/98 |
| 3,310,017 | 3/1967 | Dyer | 114/98 |
| 3,522,786 | 8/1968 | Randel-Clark | 114/106 |
| 3,552,775 | 1/1971 | Warner | 114/103 |
| 3,749,042 | 7/1973 | Jackson | 114/106 |
| 3,796,464 | 3/1974 | Hansen | 403/378 |
| 4,064,821 | 12/1977 | Roberts | 114/103 |
| 4,372,703 | 2/1983 | Szostak | 403/378 |
| 4,535,825 | 8/1985 | Hackney | 114/103 |
| 4,633,798 | 1/1987 | Skinner | 114/39.1 |
| 4,686,921 | 8/1987 | Magnan | 114/103 |

*Primary Examiner*—Joseph F. Peters, Jr.
*Assistant Examiner*—Clifford T. Bartz
*Attorney, Agent, or Firm*—Thomas E. Schatzel

[57] ABSTRACT

A batten receptacle for surrounding and firmly holding a batten and sail. The receptacle is adapted to be connected to a slide member by means of a rigid multiaxis of rotation joint. This unique joint allows for the required rotational movement while at the same time preventing harmful linear movement between the batten and the mast.

8 Claims, 1 Drawing Sheet

BATTEN ATTACHMENT

BACKGROUND OF THE INVENTION

1. Field of the Invention

The invention relates generally to sailboat batten attachments and more specifically to batten attachments which have multiple axes of rotation.

2. Description of the Prior Art

Mainsails with multiple full-length battens (full battens) have been used on certain high performance sailboats, particularly multihulls for many years. Battens are strips of fiberglass, foam, wood or combination thereof, which slip into pockets sewn into the sail. The battens quiet the sail (prevent flogging) in high wind or head to wind conditions and thereby increase the sail life. They also aid in retaining the sail's shape in a variety of wind conditions.

Recently, sail makers have been touting the benefits of full battens for monohull cruising boats. The battens are installed in a horizontal, parallel configuration. This allows the sail to be quickly released downward and stacked on the boom.

However, the use of full battens has its disadvantages. There has been a historic problem with sail wear and failure in the vicinity of the lead edge of the battens. This results from the high compression and the side loads that the battens impart to the leading edge of the batten pocket. In virtually all commercial full batten sail construction, two very strong elements (the mast and the batten) are essentially connected by much weaker materials (sailcloth and/or nylon tape). Even with strong reinforcement and batten pocket end caps, the weaker materials eventually break down near the forward end of the batten pocket, resulting in wear and outright failure.

There is another disadvantage to existing attachment methods. They do not provide adequate articulation for the batten as the sail is being hoisted or lowered. This can cause the attached mast track slide to bind and make hoisting and lowering difficult.

It is known in the prior art to provide hinged connectors between masts and sail booms. For example, U.S. Pat. Nos. 3,522,786 by Maurice Rendell-Clark and 3,749,042 by Patrick Jackson, both show mast-to-boom connectors. However, these allow limited movement and do not provide the proper connections to be useful as batten attachments. There is a need for a batten-to-mast attachment which is strong, rigid, and which provides for multiple directions of rotation.

SUMMARY OF THE PRESENT INVENTION

It is an object of the present invention to provide a strong and rigid batten attachment.

It is another object of the present invention to provide a batten attachment which allows for movement along three axes.

Briefly, in a preferred embodiment, the present invention comprises a slide member which is connected to a joint member. The joint member is rigid and provides for rotation along three axes. The joint is connected to a batten receptacle. The receptacle sandwiches the sail and batten and provides a reinforcement for the forward end of the batten pocket.

It is an advantage of the present invention in that it provides a strong and rigid batten attachment.

It is another advantage of the present invention in that it provides a batten attachment which allows for movement along three axes.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
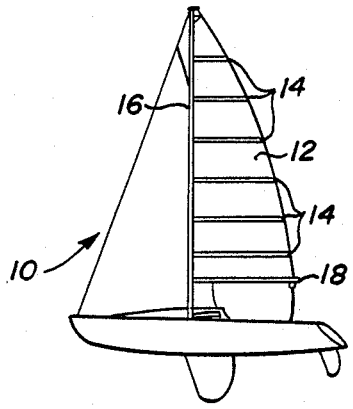
Fig 1 (PRIOR ART)
FIG. 1 shows a side elevation view of a cruising sailboat with parallel full battens.

FIG. 1 shows a crusing sailboat and is designated by the general reference number 10. Sailboat 10 has a batten sail 12 which contains a plurality of horizontal battens 14. The ail 12 is attached to a mast 16 and a boom 18.

Figure 2:
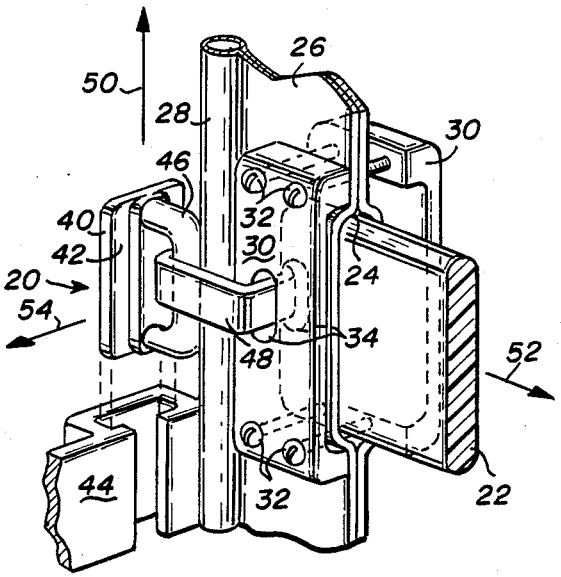
Fig 2 (PRIOR ART)
FIG. 2 shows a perspective view of a batten attachment of the prior art.

FIG. 2 shows a perspective view of a batten attachment of the prior art and is designated by the general reference number 20. A batten 22 is located inside a batten pocket 24 of a sail 26. The sail 26 is shown in a cutaway view. The sail 26 has a bolt rope 28 to provide reinforcement to the leading edge of the sail 26. A pair of plastic batten pocket end caps 30 are positioned around the forward end of batten 22. The caps 30 are bolted together with a plurality of bolts 32. The caps 30 compress to firmly hold the sail 26 in between. Each of caps 30 has an aperture 34. Batten 22 also has an aperture (not shown) which aligns with apertures 34.

A plastic slide member or car 40 has a slide section 42 which runs in a slide track 44 or car track. The slide track 44 is positioned vertically along a mast. The slide member 40 also has a handle section 46. A coil 48, having several wraps of nylon tape, loops through aperture 34 and handle 46 to secure the caps 30, the batten 22 and the sail 26 to the slide member 40.

In a Cartesian coordinate system, an axis 50 is parallel to slide track 44, an axis 52 is parallel to batten 22 and an axis 54 is perpendicular to the plane of axes 50 and 52.

The problems of the prior art may now be better understood. The critical connection is the flexible coil 48. The lack of a strong mechanical connection causes major strain on the sail cloth in the vicinity of the forward edge of batten 22. The batten 22 can push forward against the track 44. This loose arrangement also can adversely effect the sail shape. Additionally, the batten attachment 20, loose as it is, still does not permit enough rotational movement between the batten 22 and the slide member 40 to keep the slide member 40 from binding in track 44. The present invention addresses these problems.

Figure 3:
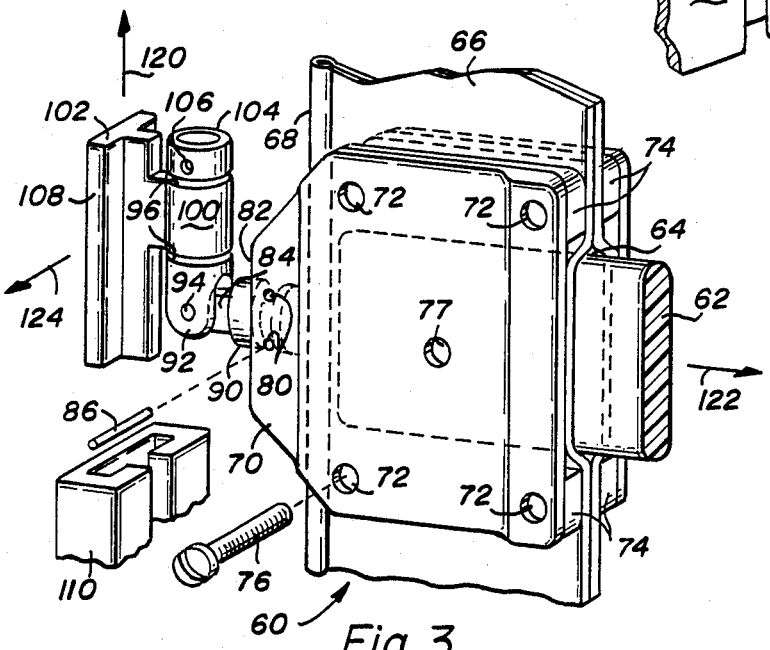
FIG. 3 shows a perspective view of a batten attachment of the present invention.

FIG. 3 shows a perspective view of the batten attachment of the present invention and referred to by the general reference number 60. A batten 62 is shown inside a batten pocket 64 of a sail 66. Sail 66 has a bolt rope 68.

A receptacle 70 surrounds the forward end of batten 62, sail 66 and bolt rope 68. Receptacle 70 has a number of bolt apertures 72. A number of plastic compression blocks 74 are positioned intermediate the receptacle 70 and sail 66 adjacent the apertures 72. A bolt 76 is passed through each of the apertures 72, compression blocks 74, sail cloth 66, second compression block 74, and second aperture 72 and is secured with a nut (not shown). Though only one bolt 76 is shown, there are three other bolt and nut assemblies similarly used. The bolt assemblies are tightened so that compression blocks 74 firmly clamp the sail 66. An optional aperture 77 may be provided such that a bolt assembly can pass through and further secure batten 62.

Receptacle 70 also has a pair of pin apertures 80 and a joint aperture 82. Aperture 82 receives an end of a joint member 84 which joint member 84 is held in place by a pair of pins 86 which pass through pin aperture 80. Joint member 84 comprises an eye swivel 90 which is pivotally attached to a fork swivel 92 by means of a pin 94. Fork swivel 92 passes through a pair of nylon bushings 96 and a bearing section 100 of a slide member 102. An end cap 104 and a pin 106 are secured to the end of fork swivel 92. The slide member 102 has a slide section 108 which fits into a slide track 110 of a mast.

In a Cartesian coordinate system, an axis 120 is parallel to track 110, an axis 122 is parallel to batten 62 and an axis 124 is perpendicular to the plane of axes 120 and 122.

Figure 4:
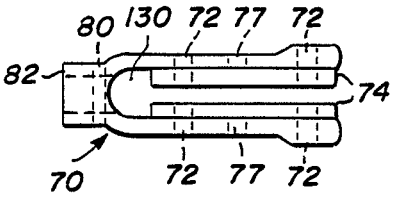
FIG. 4 shows a top elevation view of the batten receptacle of FIG. 3.
Figure 5:
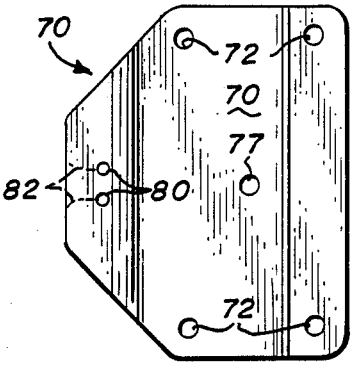
FIG. 5 shows a side elevation view of the batten receptacle of FIG. 3.

FIGS. 4 and 5 show a top elevation and side elevation view respectively of the receptacle 70 of FIG. 3. The receptacle 70 is fork shaped and may be made of an injection molded plastic or aluminum. The compression blocks 74 are rectangular in shape and each aligns with two of the apertures 72. A space 130 is provided between blocks 74 and receptacle 70 for the passage of bolt rope 68. Note that pin apertures 80 intersect joint aperture 82.

Figure 6:
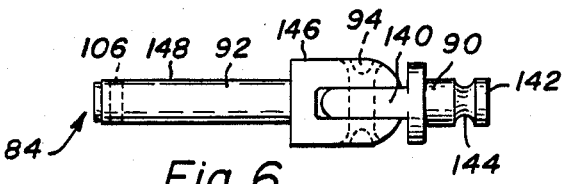
FIG. 6 shows a top elevation view of the eye and fork swivels of FIG. 3.

FIG. 6 shows a top elevation view of joint member 84 of FIG. 3. Joint member 84 may be constructed of stainless steel. Eye swivel 90 is comprised of an eye section 140 and a cylindrical section 142. Cylindrical section 142 has a semicircular shaped channel 144 which extends around its circumference. This channel 144 receives pins 86. The fork swivel 92 is comprised of a fork section 146 and an axle section 148. Eye section 140 and fork section 146 are pivotally connected by means of a pin 94. Axle section 148 has an aperture 149 for receiving pin 106.

Figure 7:
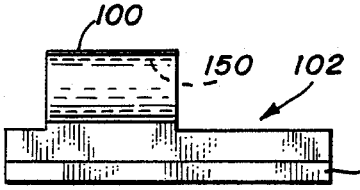
FIG. 7 shows a side elevation view of the slide member of FIG. 3.
Figure 8:
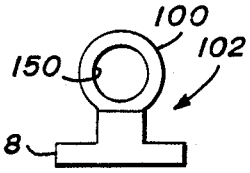
FIG. 8 shows a top elevaton view of the slide member of FIG. 3.

FIGS. 7 and 8 show a side and top elevation view respectively of the slide member 102 of FIG. 3. Slide member 102 may be constructed of stainless steel or aluminum. The bearing section 100 has a cylindrical passage 150 for receiving bushings 96 and axle section 148 of joint member 84. The slide section 108 and corresponding track 110 are rectangular shaped in the preferred embodiment. However, slide section 108 could be made of other shapes to conform to guide tracks of different shapes. For example, although the rectangular shape shown is common, some batten slide tracks are circular in cross-section and would require a cylindrical slide section.

Returning now to FIG. 3 the operation and advantages of the batten attachment 60 may now be understood. The batten attachment 60 provides a strong and rigid connection between the batten 62, sail 66, and a mast. The sail wear due to forward movement of the batten 62 is reduced. At the same time, attachment 60 provides three axes of movement which are necessary to ensure proper operation.

The connection between joint member 84 and slide member 102 allows the batten 62 to pivot about axis 120 for greater than 90° degrees on each side. This is essential to allow the entire sail 62 to pivot when the boom is adjusted to varying wind directions and conditions.

The connection between the fork swivel 92 and eye swivel 90 allows the batten to rotate about axis 124 upward at least 10° degrees and down 80° degrees. This movement is critical in preventing the slide member 102 from binding in the track 110 when the sail 66 is raised or lowered.

Finally, the connection between eye swivel 90 and receptacle 70 provides for 360° degrees of rotation of the receptacle 70 about axes 122. This feature is important in stacking the sail 66 on the boom. As the sail 66 is lowered, the sail cloth near the boom starts to flop to one side and causes the receptacle 70 to turn. When the slide 102 is at its lowered position, receptacle 70 will be turned 90° degrees along axes 122 from the position shown in FIG. 3. Thus, the entire batten sail 66 is neatly and compactly stacked on the boom. All of the battens lie in a flat horizontal position. Note, that the prior art batten attachment 20 of FIG. 2 does not allow for much rotation along axis 52 and thus the batten 22 cannot turn sideways for neat and compact stacking.

The batten attachment 60 of the present invention provides many advantages. It prevents the forward end of the batten 62 and the adjoining section of sail 66 from pushing forward. This maintains the position of the sail 66 exactly as the sail maker intended and provides a firm fulcrum around which the batten can rotate. The batten attachment 60 snugly captures the forward end of the batten 62, yet permits a wide range of rotational motion. This allows the slide member 102 to move freely in the mast track, and makes raising, lowering, and flaking of the sail easier. The invention provides a firm mechanical attachment between the batten 62 and the mast. This relieves the stress of the sail cloth in the vicinity of the forward end of the batten. This area was previously one of the few high wear areas in the otherwise long lasting full batten sail.

Figure 9:
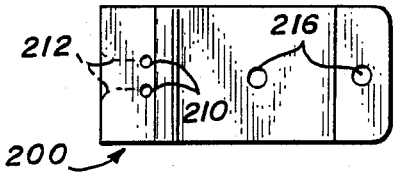
FIG. 9 shows a side elevation view of an alternative embodiment of the batten receptacle.

FIG. 9 shows a side elevation view of an alternative embodiment of a batten receptacle of the present invention and is designated by the general reference number 200. Receptacle 200 is similar in construction to receptacle 70 of FIG. 5, except that receptacle 200 is shorter in height and has fewer apertures. Apertures 210 and 212 provide for a pin connection to receive joint member 84. Receptacle 200 is similar in cross-section to receptacle 70 of FIG. 4. A pair of apertures 216 receive bolt assemblies which pass through a pair of compression blocks, a batten pocket and a batten. Receptacle 200 is used in batten sails having small sized battens.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

I claim:

1. A batten attachment comprising:

a slide member shaped to slide along a slide track of a mast, the slide track having a slide axis;

a rigid connecting link pivotally connected to the slide member to allow rotational movement about a first pivot axis parallel to said slide axis, and having a pivot means to allow rotational movement about a second pivot axis which is perpendicular to said slide axis and a batten axis which is perpendicular to said second pivot axis; and a batten receptacle shaped to receive a batten along said batten axis, the batten receptacle being pivotally connected to the connecting link to allow rotational movement about said batten axis.

2. A batten attachment comprising:

a slide member shaped to slide along a slide track of a mast, the slide track having a slide axis;

a first joint member connected to the slide member by a first pivot means to allow rotation about a first pivot axis parallel to said slide axis;

a second joint member connected to the first joint member by a second pivot means to allow rotation about a second pivot axis which is perpendicular to said first pivot axis and a batten axis which is perpendicular to said second pivot axis; and a batten receptacle connected to the second joint member by a third pivot means to allow rotation of the receptacle about said batten axis.

3. The device of claim 2 wherein, the first and second joint members are individual pieces, each of which is comprised of a rigid material.

4. The device of claim 2 wherein, the first pivot means comprises an axle and bearing connection, the second pivot means comprises an eye, fork and pin connection, and the third pivot means comprises a channel and pin connection.

5. The device of claim 2 wherein, the batten receptacle is shaped to enclose portions of a batten, sail, and a sail bolt rope, said sail bolt rope extending substantially perpendicular to said batten.

6. The device of claim 5 wherein, the batten receptacle is substantially U-shaped having a slot section with a first and second pair of compression blocks, with each block of each pair facing each other within said slot section to sandwich a portion of said sail intermediate and with the pair of blocks about opposite edges of said batten to sandwich the batten intermediate the sail portions.

7. The device of claim 6 wherein, a spacing is formed within said slot section about one terminal end of said blocks to form a spacing to receive said bolt rope; and the batten receptacle forms a joint aperture extending and intersecting said spacing, said joint aperture receiving the second joint member, and said third pivot means comprises interlocking means to pivotally lock the second joint member within said joint aperture to allow said second joint member to rotate about the axis of the batten without interfering with the bolt rope.

8. The device of claim 5 wherein, the batten receptacle is substantially U-shaped having a slot section to sandwich a pair of compression blocks, a batten and a portion of sail intermediate.

* * * * *